US005368387A

United States Patent [19]

Creighton et al.

[11] Patent Number: 5,368,387

[45] Date of Patent: Nov. 29, 1994

[54] SOAP CHIP PROCESSOR AND DISPENSER APPARATUS

[76] Inventors: Stefan D. Creighton; Dora B. Creighton, both of 23 Rutgers, Pueblo, Colo. 81005

[21] Appl. No.: 101,289

[22] Filed: Aug. 3, 1993

Related U.S. Application Data

[63] Continuation-in-part of Ser. No. 852,391, Mar. 16, 1992, abandoned.

[51] Int. Cl.[5] ..... B01F 7/16

[52] U.S. Cl. ..... 366/194; 366/184; 366/191; 366/251; 222/226

[58] Field of Search ..... 366/184, 604, 154, 155, 366/189, 190, 194, 242, 249, 251, 290, 153, 191; 422/261, 266, 267, 275, 226; 222/189, 459, 216, 385; 241/602, 46.17

[56] References Cited

U.S. PATENT DOCUMENTS

| | | | |
|---|---|---|---|
| 647,649 | 4/1900 | Chapman | 222/189 |
| 1,246,819 | 11/1917 | Lewis | 222/189 |
| 1,932,070 | 10/1933 | Grant et al. | 422/277 |
| 2,477,998 | 8/1949 | McCowan | 222/189 |
| 2,740,558 | 4/1956 | Steele | 222/189 |
| 2,816,692 | 12/1957 | Schade | 222/226 |
| 3,034,686 | 5/1962 | Santarelli | 222/189 |
| 4,121,300 | 10/1978 | Cosma et al. | 366/251 |
| 4,497,580 | 2/1985 | Doyel | 366/251 |
| 4,830,509 | 5/1989 | Gulmatico, Jr. | 366/155 |

*Primary Examiner*—David A. Scherbel
*Assistant Examiner*—Tony G. Soohoo
*Attorney, Agent, or Firm*—Phillip A. Rein

[57] ABSTRACT

A soap chip processor and dispenser apparatus including 1) a main housing assembly divided into a fluid dispensing area and a fluid mixing area; 2) a fluid dispenser assembly mounted within the fluid dispensing area; 3) a fluid mixer assembly mounted within the fluid mixing area; and 4) a compartment separator assembly mounted within the main housing assembly for separation into the fluid mixing area and the fluid dispensing area. The fluid dispenser assembly is provided with a dispensing plunger assembly to selectively pump a soap solution from the main housing assembly. The fluid mixer assembly includes a fluid agitator assembly operable to rotate a fluid mixer member to dissolve water and soap chips to form the soap solution which is dispensed through the fluid dispenser assembly. The soap chip processor and dispenser apparatus is provided with a power supply assembly utilizing rechargeable battery members for portable usage.

1 Claim, 3 Drawing Sheets

SOAP CHIP PROCESSOR AND DISPENSER APPARATUS

This is a continuation-in-part application from Ser. No. 07/852,391, filed Mar. 16, 1992, entitled "Soap Chip Processor and Dispenser Apparatus" now abandoned.

PRIOR ART

A patent search on this invention revealed the following United States patents:

| U.S. Pat. No. | Invention | Inventor |
|---|---|---|
| 2,772,116 | SOAP DISPENSERS | William J. Dobkin |
| 2,869,762 | FLUID DISPENSER | Orville F. Sanders |
| 3,289,897 | COMBINED AGITATOR AND FLUID MOVER | Arthur Ginsberg |
| 3,523,629 | LIQUID MIXING AND DISPENSING DEVICE | Yiu Dak Chi |
| 20,163 | BEVERAGE DISPENSER WITH IN-BOWL WHIPPER | Merle S. Brown |
| 4,189,071 | SOUP DISPENSER | John B. West |
| 4,364,666 | MACHINE FOR MIXING AND COOLING BATCHES OF DRY POWDER INGREDIENTS AND WATER | Rihard M. Keyes |
| 4,497,580 | TWO-MOTOR, BATTERY-OPERATED MIXER-POURER | John S. Doyel |
| 4,723,719 | INVERTIBLE/REVERSIBLE TOOL FOR USE IN A ROTARY FOOD PROCESSING APPLIANCE | James E. Williams |
| 4,859,073 | FLUID AGITATOR AND PUMP ASSEMBLY | Howseman, Jr. et al |
| 4,981,367 | PORTABLE MIXING APPARATUS | Carl L. Brazelton |

The Dobkin and Sanders patents disclose fluid dispensers utilizing a hand operated pump.

The Ginsberg and Yiu Dak Chi patents disclose main containers having therein an electrically powered mixer blade and utilizing a battery power source pump to dispense fluid therefrom.

The West patent discloses a soup dispenser which will stir a soup product and having a dispensing means thereon.

The Howseman, Jr. et al patent discloses a fluid agitator and pump assembly for mixing fluid such as water with heavier materials that settle to the bottom of the container.

The Doyel patent discloses a two-motor, battery-operated, mixer-pourer with a main container structure having a rotatable blade therein.

PREFERRED EMBODIMENT OF THE INVENTION

In one preferred embodiment of this invention, a soap chip processor and dispenser apparatus is operable to receive a fluid mixture therein comprising of water and soap chips which are processed to achieve a soap solution.

The soap chip processor and dispenser apparatus includes 1) a main housing assembly; 2) a fluid dispenser assembly mounted within the main housing assembly and selectively operable to dispense a soap solution therefrom; 3) a fluid mixer assembly mounted within the main housing assembly and operable to agitate the water and soap chip combination to achieve a final soap solution; and 4) a compartment separator assembly having a separator screen member to divide the main housing assembly into a fluid dispensing area and a fluid mixing area.

The main housing assembly includes a basic container assembly with a support lid assembly releasably mounted thereon. The basic container assembly includes a bottom wall member integral with an upright peripheral arcuate side wall, preferably of a transparent or translucent material.

The upright arcuate side wall includes a lid indentation section and a top support rim operable to receive the support lid assembly thereon in a sealing manner.

The support lid assembly includes a cover lid member having a main lid body with an outer peripheral connector flange. The main lid body is provided with a fluid dispenser opening and a container access opening.

The fluid dispenser opening is provided with an externally threaded shoulder section to receive the fluid dispenser assembly thereon. The container access opening is provided with an externally threaded access shoulder section operable to receive the fluid mixer assembly thereon.

The fluid dispenser assembly includes a dispenser body assembly having a dispenser plunger assembly connected thereto. The dispenser body assembly includes a cylindrical housing member having a fluid inlet member and a connector cap member mounted on the threaded shoulder section. The soap solution is moved on operation of the dispenser plunger assembly for selective dispensing through a fluid dispenser spout.

The fluid mixer assembly includes 1) a support and enclosure cap assembly releasably mounted on the threaded access shoulder section; 2) a fluid agitator assembly connected to the support and enclosure cap assembly; and 3) a mixer power supply assembly operable to supply a power source to the fluid agitator assembly.

The support and enclosure cap assembly includes a main cap assembly having a cap housing member with a fluid entrance member mounted thereon. The cap housing member includes 1) a fluid entrance opening; 2) a switch mounting opening; 3) a mixer enclosure member; and 4) a connector flange section with a connector threaded section. The fluid entrance member includes a pivotal enclosure cap to selectively enclose the fluid entrance opening.

The fluid agitator assembly includes a mixer drive motor which is operably connected to a fluid mixer member. The fluid mixer member includes a main support shaft having beater blades mounted on a lower outer end for selective rotation and mixing of the water and soap chip combination.

The mixer power supply assembly includes a control switch member connected to a power supply member selectively operable to supply 110 volts AC to the mixer drive motor.

The compartment separator assembly includes a separator screen member having a plurality of screen support clips about its outer periphery anchoring to the adjacent upright arcuate side wall of the basic container assembly. This retains the soap chips in the side of the fluid mixer assembly or fluid mixing area for dissolving within a fluid such as water before moving through the separator screen member for selective dispensing of a soap solution by the fluid dispensing assembly.

A second embodiment of this invention is noted in FIGS. 3 and 4 being a soap chip processor and dispenser apparatus which is rechargeably battery operated and includes 1) a main housing assembly; 2) a fluid dispensing assembly mounted within the main housing assembly; 3) a fluid mixer assembly mounted within the main housing assembly; and 4) a mixer power supply assembly mounted within the main housing assembly and operably connected to the fluid mixer assembly; and 5) a compartment separator assembly mounted within the main housing assembly to separate the area therein from a fluid dispensing area and a fluid mixing The main housing assembly includes a basic container assembly having a support lid assembly mounted thereon. The support lid assembly is as previously described in the first embodiment.

The basic container assembly has a bottom support assembly with an upright arcuate support wall connected thereto. The bottom support assembly includes a top wall member with a side support wall therein having areas thereunder to receive and store portions of the mixer power supply assembly.

The fluid dispensing assembly and the fluid mixer assembly are substantially identical to that described in the first embodiment except the fluid mixer assembly has a fluid mixer member secured to a bottom wall of the basic container assembly and having the mixer drive motor mounted thereunder.

The mixer power supply assembly includes a control switch member connected to the side support wall and a rechargeable battery assembly to selectively energize a mixer drive motor.

The compartment separator assembly includes the separator screen member mounted with screen support clips against the upright arcuate side wall similar as noted in the first embodiment.

OBJECTS OF THE INVENTION

One object of this invention is to provide a soap chip processor and dispenser apparatus having 1) a main housing assembly operable to receive a mixture therein comprising a fluid such as water and a fluid soluble material such as soap chips for processing to a fluid solution; 2) a fluid dispenser assembly mounted on a fluid dispenser area of the main housing assembly to selective dispense the fluid solution therefrom; 3) a fluid mixer assembly mounted on a fluid mixing area of the main housing assembly for selective energization to dissolve the material within the fluid solution; and 4) a compartment separator assembly operable to separate the main housing assembly into the fluid dispensing area and the fluid mixing area.

Another object of this invention is to provide a soap chip processor and dispenser apparatus having a fluid mixer assembly which can be 1) energized to 110 volt power source through a control switch member; or 2) energized through a power supply assembly having a rechargeable battery assembly whereby the processor dispenser apparatus is portable and rechargeable.

Still, another object of this invention is to provide a soap chip processor and dispenser apparatus having 1) a main housing assembly of arcuate oblong shape; 2) a compartment separator assembly to separate the main housing assembly into a fluid dispensing area and a fluid mixing area; and 3) a fluid mixer assembly whereby the fluid mixer assembly operates to create a continuous flow of fluid against and through a compartment separator assembly to break up and dissolve soap chips into a fluid solution.

One other object of this invention is to provide a soap chip processor and dispenser apparatus having 1) a main housing assembly separated by a compartment separator assembly into a) a fluid mixing area to receive water and soap chips for periodic mixing thereof to form a soap solution; b) a fluid dispensing area mounted on the other side of the compartment separator assembly and operable to selectively dispense a soap solution therefrom.

Still, one other object of this invention is to provide a soap chip processor and dispenser apparatus which is economical to manufacture; simple to use; using either 110 volt or rechargeable battery power for the operation thereof; and substantially maintenance free.

Various other objects, advantages, and features of the invention will become apparent to those skilled in the art from the following discussion, taken in conjunction with the accompanying drawings, in which:

FIGURES OF THE INVENTION

Figure 3:
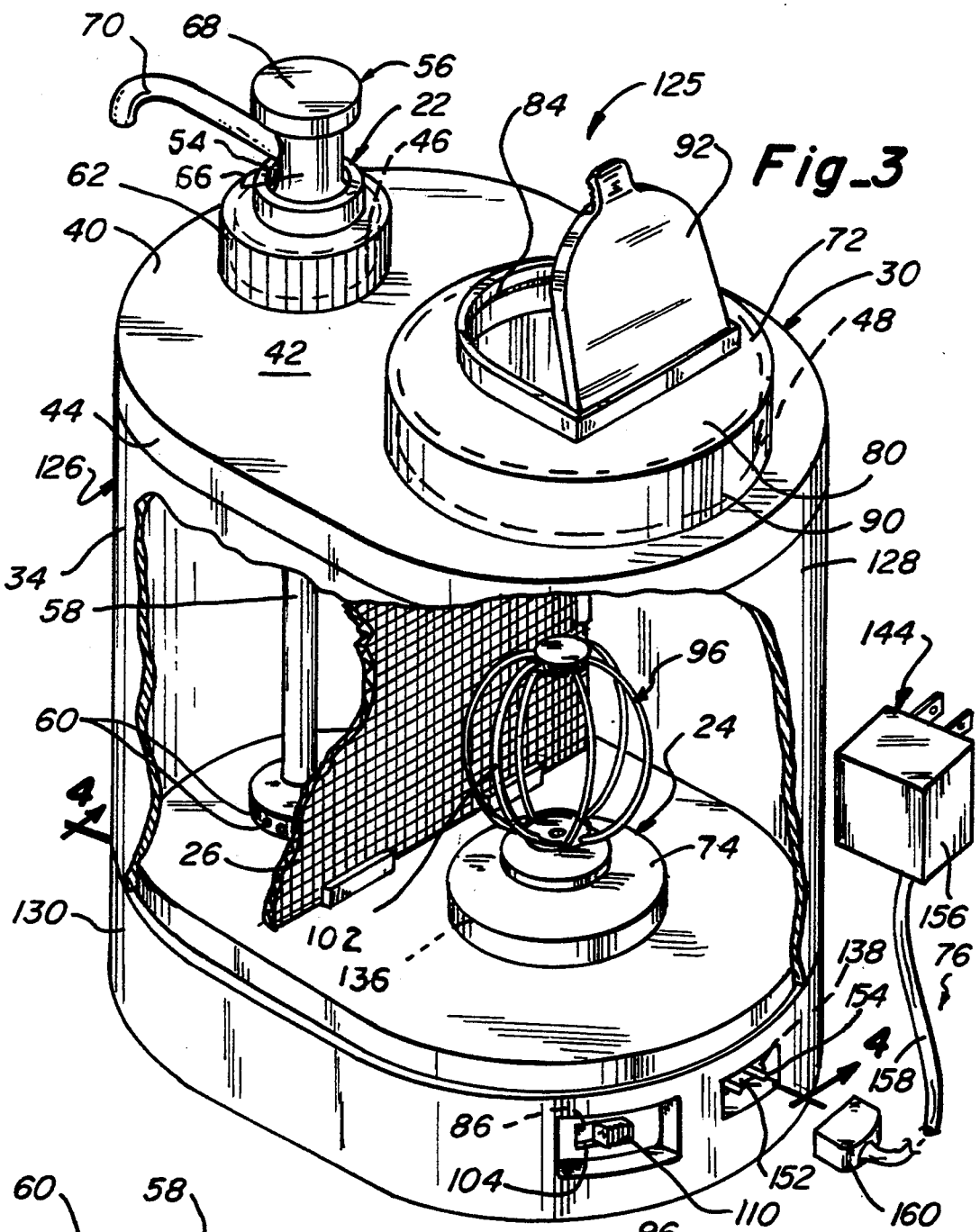
FIG. 3 is a perspective view of a second embodiment of a battery operated soap chip processor and dispensing apparatus having portions broken away for clarity.
Figure 4:
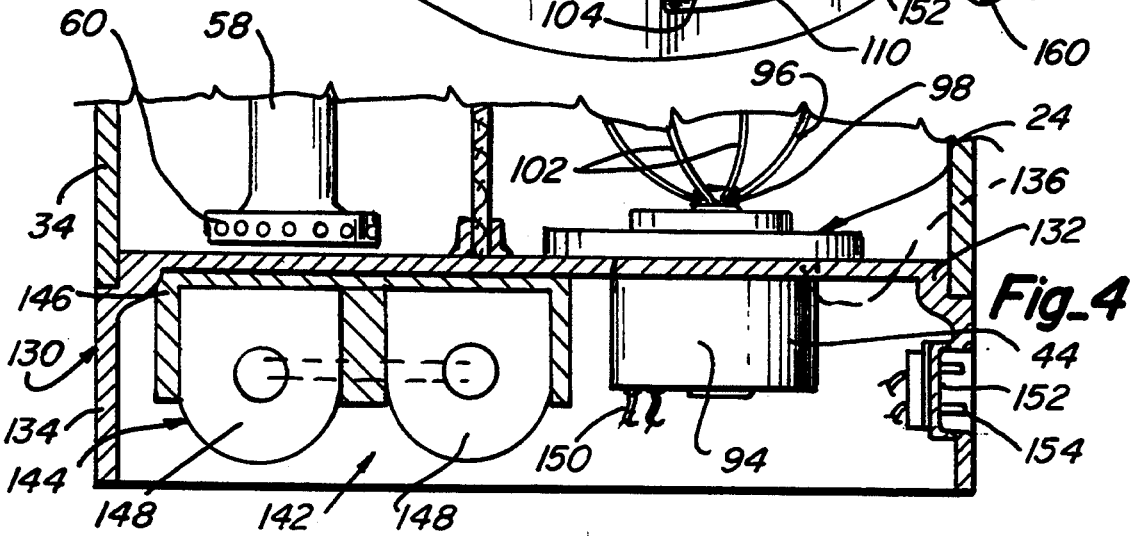
Figure 7:
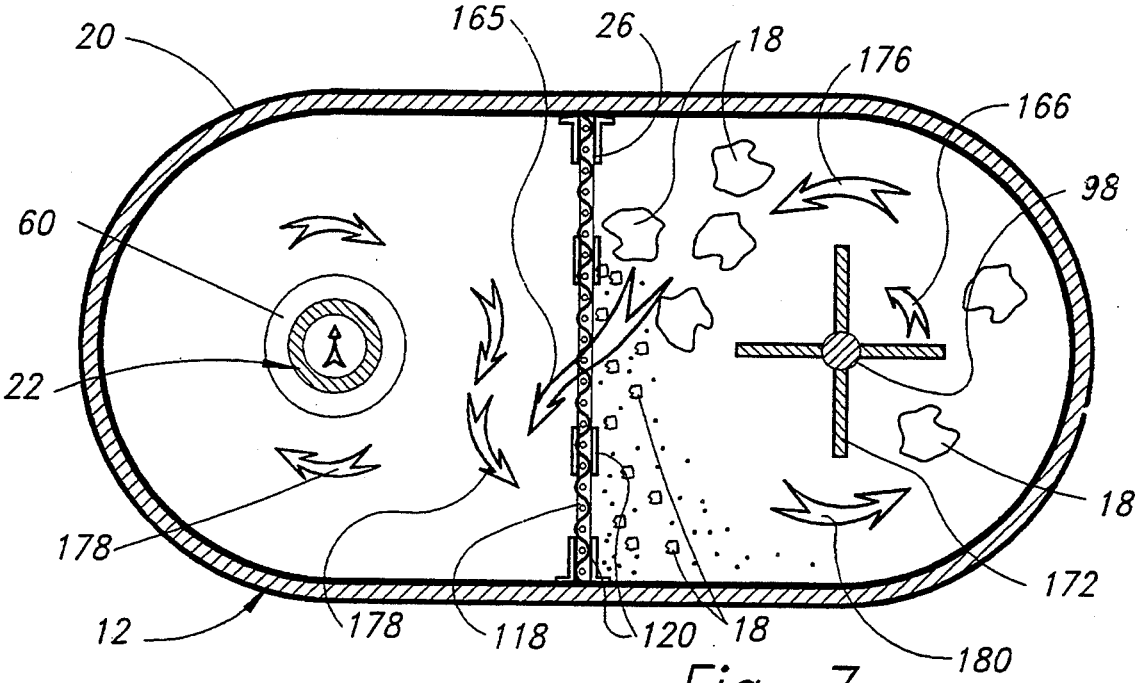
Figure 5:
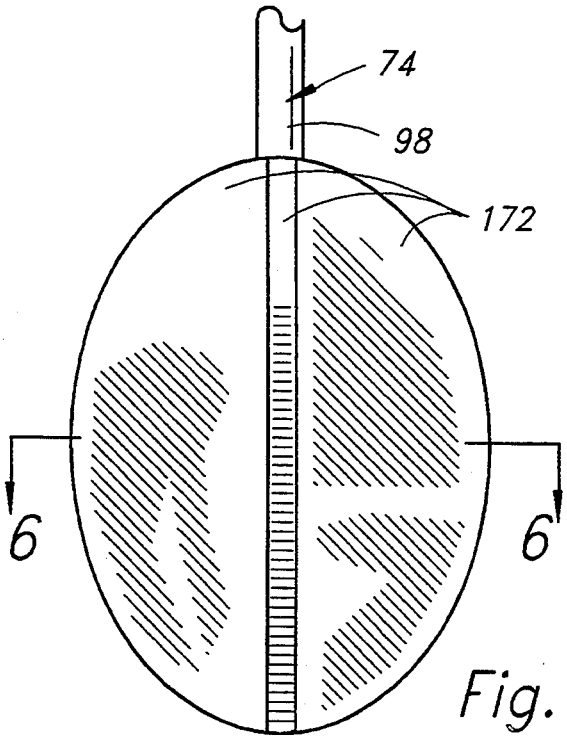
Figure 6:
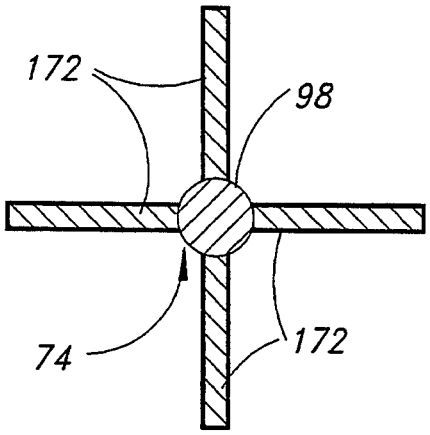

FIG. 4 is a fragmentary sectional view taken along line 4—4 in FIG. 3 FIG. 5 is an enlarged elevational view of a third embodiment of a fluid mixer member; FIG. 6 is a sectional view taken along line 6—6 in FIG. 5; and FIG. 7 is a sectional view taken along line 7—7 in FIG. 1

The following is a discussion and description of preferred specific embodiments of the soap chip processor and dispenser apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
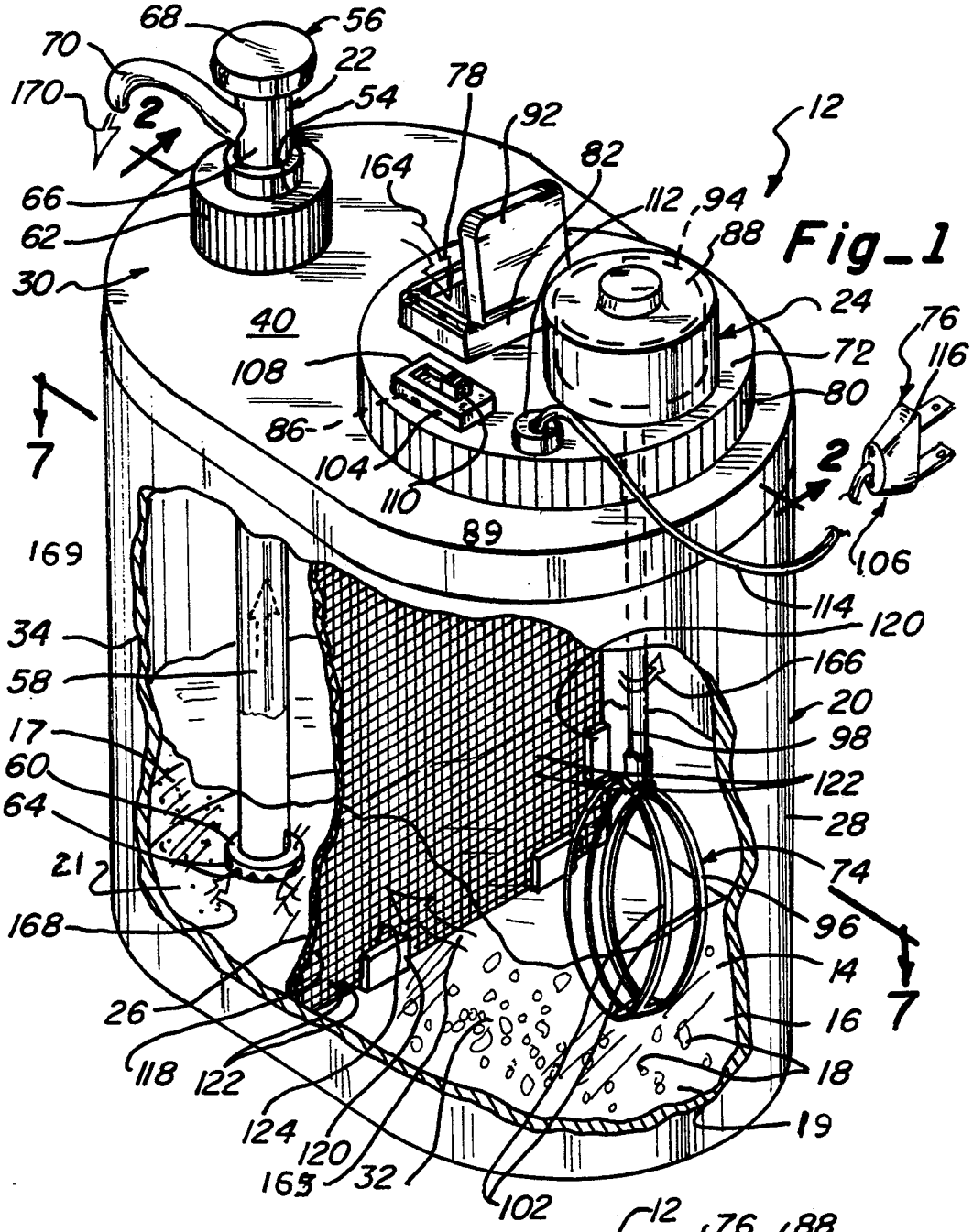
FIG. 1 is a perspective view of a soap chip processor and dispenser apparatus of this invention with portions broken away for clarity.

Referring to the drawings in detail and, in particular to FIG. 1, a soap chip processor and dispenser apparatus of this invention, indicated generally at 12, is operable to receive a fluid mixture 14 therein which may be comprised of water 16 and soap chips 18 which are to be mixed therein to produce a dissolved fluid or soap solution 17.

The soap chip processor and dispenser apparatus 12 includes 1) a main housing assembly or means 20; 2) a fluid dispenser assembly or means 22 mounted at one end portion of the main housing assembly 20; 3) a fluid mixer assembly or means 24 mounted within another end portion of the main housing assembly 20; and 4) a compartment separator assembly or means 26 mounted within a central portion of the main housing assembly 20 to divide into a fluid mixing area 19 and a fluid dispensing area 21.

The fluid dispensing area 21 has the fluid dispenser assembly 22 therein with the soap solution 17 so it can be pumped from the fluid dispenser assembly 22 as will be explained.

The fluid mixing area 19 has the fluid mixer assembly 24 therein and is operable to agitate the water 16 and soap chips 18 selectively to produce the soap solution 17 in a manner to be explained.

The main housing assembly 20 includes a basic container assembly 28 having a support lid assembly 30 releasably mounted thereon.

The basic container assembly 28 includes a bottom wall member 32 having a peripheral upright arcuate side wall 34 extended upwardly therefrom.

Figure 2:
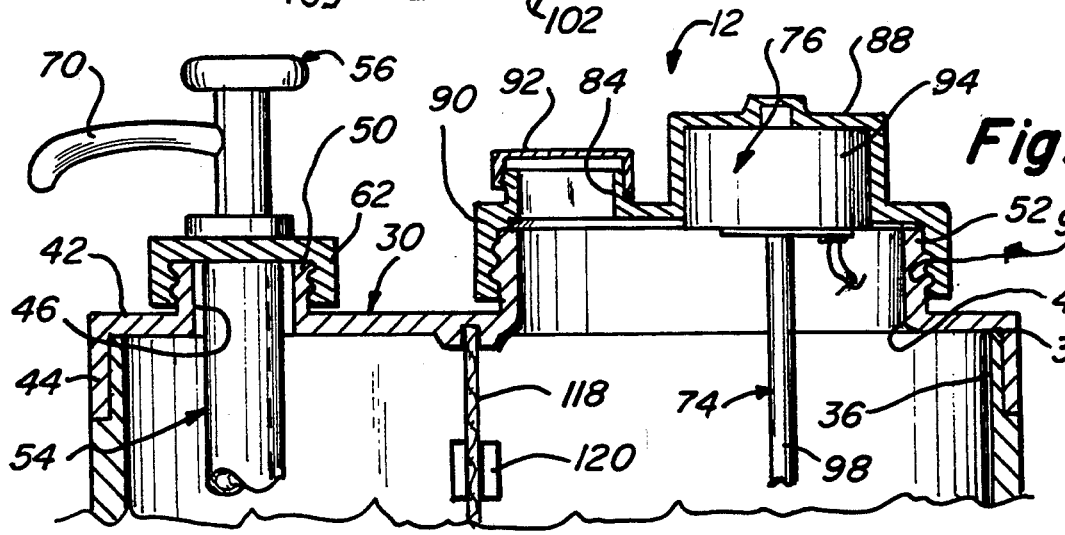
FIG. 2 is a fragmentary sectional view taken along line 2—2 in FIG. 1.

The upright arcuate side wall 34 is preferably of a transparent or translucent material to indicate a fluid level therein and having a lid indentation section 36 integral with a top support rim 38, as noted in FIG. 2, to receive and support the support lid assembly 30 thereon.

The upright side wall 34 is of an oblong shape in a horizontal transverse cross section with facing, arcuate end wall sections. The arcuate, oblong shape is important in creating a fluid current to rapidly dissolve the soap chips 18 in a manner to be described.

The support lid assembly 30 includes a cover lid member 40 having a main lid body 42 with an outer peripheral connector flange 44 to be received against and within the lid indentation section 36 and the top support rim 38 of the upright arcuate side wall 34.

As noted in FIG. 2, the main lid body 42 has a fluid dispenser opening 46 and a container access opening 48 therein. The fluid dispenser opening 46 has an externally threaded shoulder section 50. The container access opening 48 is provided with an externally threaded access shoulder section 52 for reasons to become obvious.

The fluid dispenser assembly 22 is of a substantially conventional nature having a dispenser body assembly 54 with a dispenser plunger assembly 56 connected thereto. The dispenser body assembly 54 includes a cylindrical housing member 58 having a fluid inlet member 60 secured to a lower end thereof and a connector cap member 62 connected to an upper end thereof and mounted about the externally threaded shoulder section 50 about the fluid dispenser opening 46.

The fluid inlet member 60 is provided with a plurality of spaced entrance holes 64 to draw the soap solution 17 therein for dispensing upwardly and outwardly of a cylindrical housing member 58.

The dispensing plunger assembly 56 includes a piston member 66 with an actuator knob member 68 secured to an upper end and a fluid dispenser spout 70 communicating with the piston member 66.

The piston member 66 is moved upwardly and downwardly through contact and movement of the actuator knob member 68 by conventional operation of a piston, cylinder, and check valve member for dispensing the soap solution 17 outwardly of the fluid dispenser spout 70 selectively in a manner to be explained.

The fluid mixer assembly 24 includes 1) a support and enclosure cap assembly 72 mountable about the container access opening 48 and, more specifically, on the externally threaded access shoulder section 52; 2) a fluid agitator assembly 74 mounted on the support and enclosure cap assembly 72, and 3) a mixer power supply assembly 76 connected to the fluid agitator assembly 74.

The support and enclosure cap assembly 72 includes a main cap assembly 78 having a cap housing member 80 and a fluid entrance member 82.

The cap housing member 80 is provided with 1) a fluid entrance opening 84; 2) a switch mounting opening 86; 3) a mixer motor enclosure member 88: 4) a power supply opening 89; and 5) a connector flange section 90 about an outer periphery having a connector internal threaded section 91 mountable on the externally threaded access shoulder section 52 of the container access opening 48 of the support lid assembly 30.

The fluid entrance member 82 is provided with a pivotal enclosure cap 92 and is selectively opened to place the water 16 and the soap chips 18 therein in an operational step as will be explained.

The fluid agitator assembly 74 includes a mixer drive motor 94 connected to a fluid mixer member 96. The mixer drive motor 94 is energized by a 110 AC volt power supply in order to rotate the fluid mixer member 96. The fluid mixer member 96 includes a support shaft 98 having a plurality of spaced beater blades 102 secured to an outer end of the support shaft 98.

The mixer power supply assembly 76 includes a control switch member 104 and a power supply member 106. The control switch member 104 includes a switch housing 108 having a slide switch 110 mounted therein and being mounted within the switch mounting opening 86 in the cap housing member 80.

The power supply member 106 includes 1) a support grommet 112 mounted within the power supply opening 89 in the cap housing member 80; 2) a cord member 114 connected to the support grommet 112 and electrically to the control switch member 104 and the mixer drive motor 94; and 3) a plug member 116 mounted on an outer end of the cord member 114 for placing in a conventional 110 volt electrical receptacle outlet.

The compartment separator assembly 26 includes a separator screen member 118 secured about its outer periphery by a plurality of spaced screen support clips 120 to adjacent portions of the arcuate side wall 34.

The separator screen member 118 is provided with a plurality of fluid flow openings 122 illustrated as square shape, each being a size so as to prevent the soap chips 18 from flowing therethrough but allowing the soap solution 17 to readily flow to the fluid dispensing area 21.

The screen support clips 120 are of a generally U-shape in transverse cross section having central support grooves 124 to be placed about and support adjacent areas of the separator screen member 118 in a sealing manner against the arcuate side wall 34.

In the second embodiment of this invention, a soap chip processor and dispenser apparatus 125 is of a rechargeable battery operated type unit so as to be portable and not dependent on a conventional 120 volt AC power source.

The soap chip processor and dispenser apparatus 125 includes 1) a main housing assembly 126; 2) a fluid dispensing assembly 22 as previously described mounted within the main housing assembly 126; 3) a fluid mixer assembly 24 mounted within the main housing assembly 126 as previously described; 4) a mixer power supply assembly 76 mounted within the main housing assembly 126; and 5) a compartment separator assembly 26 as previously described to separate the main housing assembly 126 into the fluid mixing area 19 and the fluid dispensing area 21.

The main housing assembly 126 includes a basic container assembly 128 having a support lid assembly 30 mounted thereon. The basic container assembly 128 includes a bottom support assembly 130 having an integral upright arcuate side wall 34 similar to the first embodiment.

The bottom support assembly 130 includes a top wall member 132 with a side support wall 134 connected thereto. The top wall member 132 is provided with a mixer mount opening 136 therein. The side support wall 134 is provided with a power plug opening 138 and a switch mounting opening 86.

The upright arcuate side wall 34 is provided with a lid indentation section 36 and a top support rim 38, as noted in FIG. 2 in the first embodiment, to receive the support lid assembly 30 thereon.

The support lid assembly 30 is provided with the cover lid member 40 having a main lid body 42 with an outer, downwardly depending connector flange 44. The main lid body 42 is provided with the fluid dispenser opening 46 and the container access opening 48.

The fluid dispenser assembly 22 is substantially identical as described in the first embodiment having the dispenser body assembly 54 with the dispenser plunger assembly 56 connected thereto. The piston member 66 is operable to be depressed by the actuator knob member 68 to dispense the soap solution 17 outwardly through the fluid dispenser spout 70 in a conventional manner.

The fluid mixer assembly 24 includes 1) a support and enclosure cap assembly 72; 2) a fluid agitator assembly 74; and 3) a fluid mixer member 96 connected assembly 74. The fluid agitator assembly 74 includes a mixer drive motor 94 connected to the fluid mixer member 96. The fluid mixer member 96 includes a support shaft 98 connected to a plurality of beater blades 102.

The mixer power supply assembly 76 includes 1) a control switch member 104 to control power to the mixer drive motor 94; 2) a power supply assembly 142; and 3) a rechargeable battery assembly 144 connectable to the power supply assembly 142.

The control switch member 104 has a slide switch 110 movable between "on" and "off" positions and mounted within the switch mounting opening 86.

The power supply assembly 142 includes a battery support housing 146 having a plurality of battery members 148, namely two, mounted therein and electrically connected by a battery cord member 150 to the mixer drive motor 94 through the control switch member 104.

The power supply assembly 14 includes a power inlet charge member 152 having connector prongs 154 which are engagable with the rechargeable battery assembly 144 as will be noted.

More particularly, the rechargeable battery assembly 144 includes a transformer member 156 which is connectable to a normal electrical receptacle to receive a 110 volt AC power which is converted to 12 volt DC and connected by a connector power cord 158 and a rechargeable plug member 160 to the connector prongs 154. Therefore, the rechargeable battery assembly 144 is operable to recharge the battery members 148 as deemed necessary.

The compartment separator assembly 26 is as previously described having the separator screen member 118 secured about its outer periphery by screen support clips 120 to divide the interior of the basic container assembly 128 into a fluid dispensing area 21 and a fluid mixing area 19.

As noted in FIGS. 5 and 6, a third embodiment of the fluid mixer assembly 24 includes a fluid agitator assembly 74 having a supported shaft 98 connected to a plurality of, namely four, beater blades 172. The beater blades 172 are of a solid plate construction operable to create a strong fluid agitation or current on rotation of the support shaft 98 by the mixer drive motor 94 as will be explained.

USE AND OPERATION OF THE INVENTION

In the use and operation of the soap chip processor and dispenser apparatus 12 of this invention as noted in FIGS. 1 and 2, the support lid assembly 30 is mounted in a secure manner on the basic container assembly 28. The separator screen member 18 is mounted in the basic container assembly 28 to divide the interior into the fluid mixing area 19 and the fluid dispensing area 21.

Next, the operator can open the pivotal enclosure cap 92 about the fluid entrance member 82 in order to add water 16 and soap chips 18 therein as noted by an arrow 164. The soap chips 18 would be confined in the fluid mixing area 19 due to the presence of the separator screen member 118 as clearly noted in FIG. 2.

On adding a sufficient Mount of the soap chips 18 and water 16 within the basic container assembly 28, it is obvious that the operator would move the slide switch 110 to the "on" position which would energize the mixer drive motor 94 which would then cause rotation of the support shaft 98 and interconnected beater blades 102 as noted by an arrow 166.

This would cause a fluid agitation within the fluid mixing area 19 which would then cause the soap chips 18 to dissolve within the water 16 to form the soap solution 17. This soap solution 17 would freely move transversely of the separator screen member 118 as noted by an arrow 165 in FIG. 1. The slide switch 110 can be moved to the "off" position with only the soap solution 17 present in the basic container assembly 28.

Next, the operator of the soap chip processor and dispenser apparatus 12 can use the fluid dispensing assembly 22 and, more particularly, movement of the piston member 66 within the cylindrical housing member 58. This causes the soap solution 17 to move toward the fluid inlet member 60 as noted by arrows 168 upwardly within the cylindrical housing member 58 as noted by an arrow 169 in FIG. 1 for dispensing outwardly of the fluid dispenser spout 70 as noted by an arrow 170.

The use and operation of the second embodiment, being the soap chip processor and dispenser apparatus 125 as noted in FIGS. 3 and 4, is substantially identical to the first embodiment except, in this case, the lower basic container assembly 128 provides a neat storage area for the power supply assembly 142 and the mixer drive motor 94.

In this second embodiment, the rechargeable battery members 148 are used therein which makes this unit completely portable and being rechargeable as necessary.

On use of the third embodiment of the fluid mixer assembly 24, the fluid agitator assembly 74 has the support shaft 98 connected to and driven by the mixer drive motor 94. The rotating beater blades 172 create a strong fluid current to agitate and move the fluid or water 16 and the soap chips 18 as noted by arrows 166 and 176.

The soap chips 18 are propelled by the fluid current against the separator screen member 118 and broken into smaller pieces as shown in FIG. 7. This decreases the time necessary for the water 16 and soap chips 18 to form the soap solution 19.

The fluid current moves in a generally FIG. "8" motion as noted by arrows 165, 166, 176, 178, and 180 to efficiently dissolve the soap chips 18 into the soap solution 19.

As the arcuate side wall 34 is constructed of a transparent or translucent material, the status of the soap chips 18 can be readily observed by an operator thereof.

The soap chip processor and dispenser apparatus is important in recycling used soap bar pieces that are normally discarded and now are used as a soap solution, thus, saving our natural resources plus monetary savings through use of the invention.

It is noted that the soap chip processor and dispenser apparatus could be used with a mixture of any fluid soluble material and a fluid for processing into a material dissolved solution for subsequent removal from the main housing means by the fluid dispenser means or other removal methods.

It is seen that the soap chip processor and dispenser apparatus of this invention is economical to manufacture; operable to be utilized on either a 110 volt power source or rechargeable battery members; easy to use and clean; and substantially maintenance free.

While the invention has been described in conjunction with preferred specific embodiments thereof, it will be understood this description is intended to illustrate and not to limit the scope of the invention, which is defined by the following claims:

We claim:

1. A soap chip processor and dispenser apparatus having a mixture of water and soap chips for processing into a soap solution, comprising:

a) a main housing means having a fluid mixing area and a fluid dispensing area;

b) a fluid mixer means mounted within said fluid mixing area to agitate a combination of the water and soap chips;

c) a compartment separator means vertically mounted in said main housing means to divide into adjacent ones of said fluid mixing area and said fluid dispensing area having equal fluid levels;

d) said compartment separator means operable to retain the soap chips within said fluid mixing area until dissolved with the water to form the soap solution which will flow through said compartment separator means for removal from said fluid dispensing area;

e) said main housing means includes a basic container assembly having a support lid assembly removably mounted on said basic container assembly;

said support lid assembly includes a main lid body integral with an outer connector flange engagable with said basic container assembly;

g) a fluid dispenser means mounted in said fluid dispensing area and selectively operable to receive and dispense the soap solution through a fluid dispenser spout mounted in a fluid dispenser opening in said support lid assembly for reclaiming of the normally discharged soap chips;

h) said support lid assembly having a container access opening therein for access to said fluid mixing area;

i) said support lid assembly encloses and permits separate access to said fluid mixing area and said fluid dispensing area; and j) said container access opening is operable to receive the water and soap chips therethrough for placement within said fluid mixing area;

whereby said soap chip processor and dispenser apparatus is operable to receive a mixture of water and soap chips which are obtained from worn out soap bars which are normally discarded and, therefore, this invention provides a recycling process for conservation purposes.

* * * * *